US011784422B2

(12) United States Patent
Hsu

(10) Patent No.: US 11,784,422 B2
(45) Date of Patent: Oct. 10, 2023

(54) JUNCTION BOX

(71) Applicant: Hung Sheng Hsu, Taipei (TW)

(72) Inventor: Hung Sheng Hsu, Taipei (TW)

( * ) Notice: Subject to any disclaimer, the term of this patent is extended or adjusted under 35 U.S.C. 154(b) by 102 days.

(21) Appl. No.: 17/556,255

(22) Filed: Dec. 20, 2021

(65) Prior Publication Data

US 2022/0216625 A1 Jul. 7, 2022

(30) Foreign Application Priority Data

Jan. 1, 2021 (TW) ..... 110100001

(51) Int. Cl.
*H01R 9/24* (2006.01)
*H01R 4/48* (2006.01)

(52) U.S. Cl.
CPC ..... *H01R 9/2416* (2013.01); *H01R 4/4818* (2013.01)

(58) Field of Classification Search
CPC ..... H01R 9/2416–4/4818
See application file for complete search history.

(56) References Cited

U.S. PATENT DOCUMENTS

| | | | | |
|---|---|---|---|---|
| 7,686,627 | B2 * | 3/2010 | Wu | H01R 9/2691 439/95 |
| 9,525,218 | B2 * | 12/2016 | Wu | H01R 4/4818 |
| 10,367,276 | B2 * | 7/2019 | Wu | H01R 9/2416 |
| 10,411,371 | B2 * | 9/2019 | Pizzi | H01R 9/2416 |
| 10,446,946 | B2 * | 10/2019 | Wu | H01R 9/2416 |
| 10,770,809 | B1 * | 9/2020 | Wu | H01R 4/4836 |
| 2014/0287630 | A1 | 9/2014 | Hoppmann | |

FOREIGN PATENT DOCUMENTS

EP 3320582 A1 5/2018

* cited by examiner

*Primary Examiner* — Vanessa Girardi
(74) *Attorney, Agent, or Firm* — MUNCY, GEISSLER, OLDS & LOWE, P.C.

(57) ABSTRACT

A junction box including a box body and a conductive bar. A guide plate extends from a lead insertion opening, with a laterally extended connection portion at its extended end to connect the box body. First and second support plates and edges of the guiding plate form passages accessible to a lead insert space defined by the guiding plate, the connecting portion, the second support plate and the box body. The conductive bar has a bent conductive arm that moves into the inside of the lead insert space by an elastic force, therefore locked in said space, after it passes the passages.

17 Claims, 7 Drawing Sheets

JUNCTION BOX

TECHNICAL FIELD OF THE INVENTION

The present invention relates to a junction box, in particular to a junction box that has a simplified and rigid structure and is easy to assemble.

BACKGROUND OF THE INVENTION

Junction box, also known as terminal box, is a connector device used to electrically connect one lead with one or more other leads, or with one or more electrical connector terminals.

The basic structure of the junction box includes a housing, a lead insertion hole or insertion opening, at least one conductive bar, and at least one spring clamp for pressing an inserted lead against the conductive bar. The connection between the lead and other leads or connector terminals is accomplished by the conductive bar. The junction box also provides a guide plate at a downstream position relative to the lead insertion hole or insertion opening, to guide the lead, especially the bare conductor at the front end of the lead. In application, several junction boxes are tightly arranged side by side, therefore necessary insulating elements must be provided between two of them, to avoid contact between the conductive elements of two adjacent junction boxes, which forms a short circuit.

US Patent Publication US2014/0287630 discloses a "Connecting terminal with a web-shaped conductor guide." The connecting terminal is in the form of a junction box, and a guide plate extending in the direction of the box body is arranged at the lead insertion opening. On the one hand, it is used to guide the insertion of the lead and on the other hand to isolate the exposed part of the lead end. A conductive bar forms a U-shape that opens upward. The two side arms of the conductive bar are respectively used for electrical connection with a lead inserted into the box through the insertion opening. The end of the guide plate away from the insertion opening forms a free end. A gap is formed between the free end and the bottom plate of the box body. A gap is also formed between one side of the guide plate and the side wall of the box body. One side arm of the conductive bar and a portion adjacent to the side arm are respectively inserted into the side gap and the free end gap, whereby the conductive bar is affixed in the junction box. A portion of the width of the conductive bar that exposes from the gaps surrounds the space covered by the guide plate and provides a surface for electrical contact with the inserted lead. A spring clamp in the box body, at a side of the guide plate, presses the lead, that is, the bare end of the lead, to the side arm to form a firm electrical contact. On the other side of the U-shape, the junction box also provides a similar structure for inserting another lead to form an electrical connection with the other side bar of the conductive bar.

European Patent Publication EP3320582 discloses a connection terminal, which also forms a junction box. The junction box is used to electrically connect an inserted lead with a bus bar. A guide plate is provided below the lead insertion opening, that is, downstream of the insertion direction. A gap is formed between the guide plate and a stopper. An L-shaped conductive bar is disposed in the gap. A first spring clamp presses the conductive bar to the bus bar. A second spring clamp presses the inserted lead against the conductive bar. In the prior art, the conductive bar of the junction box is embedded in a gap formed by the lead guide plate and the box wall for fixation. The guide plate configured in this way can be integrally formed with the junction box body, and at the same time provides the functions of guiding, insulating and fixation. However, because this guide plate extends from the lead insertion opening, and its extended end provides a free end for the conductive bar to engage, the free end portion is easy to withstand excessive pressure and rupture, causing the conductive bar to fall off.

SUMMARY OF THE INVENTION

The objective of the present invention is to provide a junction box with a novel structure that can overcome the shortcomings of the conventional device.

The junction box according to the present invention comprises:

a box body, with at least one lead insertion opening provided on the box body for inserting a lead;

a guide plate extending towards an internal of the box from a position of the box body adjacent to the lead insertion opening, to guide the lead after being inserted;

wherein an extended end of the guide plate forms a lateral connecting portion, which is connected to the box body, and wherein the box body provides a first positioning plate and a second positioning plate, both protruding laterally, and the guide plate, the first and second positioning plates are configured to form a first passage space between the lower end of the guide plate and the first positioning plate, and a second passage space between the second positioning plate and one side edge of the guide plate; and wherein the guide plate, the connecting portion and the second positioning plate define a lead insertion space accessible from the second passage space; wherein the first and/or second positioning plate can also be the box wall of the box body;

a conductive bar formed in a plate shape and having at least one bend to form a main body and at least one first conductive arm in connection with the main body with a bent section;

wherein a part of the main body of the conductive bar is disposed between the extended end connecting portion of the guide plate and the first positioning plate, and the first conductive arm of the conductive bar is located in the lead insertion space;

characterized in that the thickness of the bent section and the first conductive arm of the conductive bar is so configured that the first conductive arm can pass through the second passage space and enter the lead insertion space; and that the first conductive arm of the conductive bar is configured to move from the plane where the second passage space is located into the lead insertion space, after the first conductive arm passes the second passage space.

The junction box may further comprise a spring clamp disposed in the lead insertion space, at an opposite side of the first conductive arm, to press the inserted lead toward the first conductive arm.

The junction box may further comprise a second lead insertion opening, a second guide plate, and the conductive bar may also comprise a second conductive arm located on an end the main body opposite to the first conductive arm and extending parallel to the first conductive arm. The arrangements of the second lead insertion opening, the second guide plate and the second conductive arm correspond to that of the first lead insertion opening, the first guide plate and the first conductive arm. In this embodiment, the junction box may also include a second clamp for pressing a lead inserted through the second lead insertion opening to the second conductive arm.

To be specific, in this embodiment the box body further provides a second set of laterally protruding first positioning plates and second positioning plates, and the second set is configured to form a first passage space between the first positioning plate and the extended end of the second guide plate, and a second passage space between the second positioning plate and one side edge of the second guide plate; and the second guide plate, the connecting portion and the second positioning plates of the second set define a second lead insertion space, whereby the second lead insertion space is accessible from the second passage space of the second set; a part of the main body of the conductive bar is disposed between the extended end connection portion of the second guide plate and the first positioning plate; the second conductive arm of the conductive bar moves from the plane of the second passage space into the second lead insertion space, after the second conductive arm passes the second passage space.

In a preferred embodiment of the present invention, the first conductive arm and/or the second conductive arm is preferably moved into the first and/or second lead insertion space by an elastic force, after it pass through the second passage space. In such embodiments, one or more slight bend may be formed on the main body of the conductive bar. For example, a bend that protrudes opposite to the extending direction of the first conductive arm and/or the second conductive arm may be formed. When assembling the conductive bar, flatten the main body with hands or a jig and insert the conductive bar into the first and second passage spaces. After passing through, release the external force to restore the conductive bar to its original shape. The first conductive arm and/or the second conductive arm will move to the lead insertion space due to elastic forces.

Alternatively or additionally, the first conductive arm and/or the second conductive arm of the conductive bars may be further bent in the direction of the main body, so that the bent section forms an angle slightly less than 90 degrees. When assembling, the main body is flattened with hands or a jig and then inserted into the first and second passage spaces. After passing, the external force is released to restore the conductive bar to its original shape. The first conductive arm and/or the second conductive arm moves into the lead insertion space due to elastic forces.

In addition, the free ends of the first conductive arm and/or the second conductive arm of the conductive bar can also be arranged to bend in the direction of the main body first, and then bend in the direction opposite to the main body, forming two bends. This design helps to make the end section of the free end face straight, to form a larger area of contact with the inserted lead.

In the above various embodiments, the free end of the first conductive arm and/or the second conductive arm of the conductive bar may be formed, for example, with an inscribed circular arc surface, so as to be compatible with a generally cylindrical shape of the inserted lead, to form a better contact.

After the assembly is completed, the conductive bar will be located in the lead insertion space between the guide plate and the box body. It is usually not located in the gap between the side edge of the guide plate and the positioning plates on both sides. In a preferred embodiment of the present invention, a positioning block may be provided at the connecting portion between the lower end of the guide plate and the box body. At the same time, a positioning notch can also be provided at the corresponding position of the main body of the conductive bar. When assembling, after the conductive bar passes through the first and second passage space, the positioning block can be embedded in the positioning notch to achieve a stable positioning.

Alternatively or additionally, a positioning notch may be provided in the connecting portion, and a positioning block is formed at a corresponding position of the main body of the conductive bar. The assembly may be accomplished in the same way.

In some preferred embodiments of the present invention, a convex stopper is formed on the main body of the conductive bar, at a position corresponding to an inner edge of the guide plate after assembly, to stuck the conductive bar, after the conductive bar passes through the second passage space. In this way, the positioning notch can be omitted.

These and other objectives and advantages of the present invention can be more clearly appreciated from the following description of the preferred embodiments of the present invention and with reference to the drawings.

DETAILED DESCRIPTION OF THE INVENTION

Several embodiments of the junction box of the present invention will be described below with reference to the drawings. The purpose of the embodiments is to enable readers to understand the basic principles, important and general features of the present invention, and not to limit the scope of the present invention.

Figure 1:
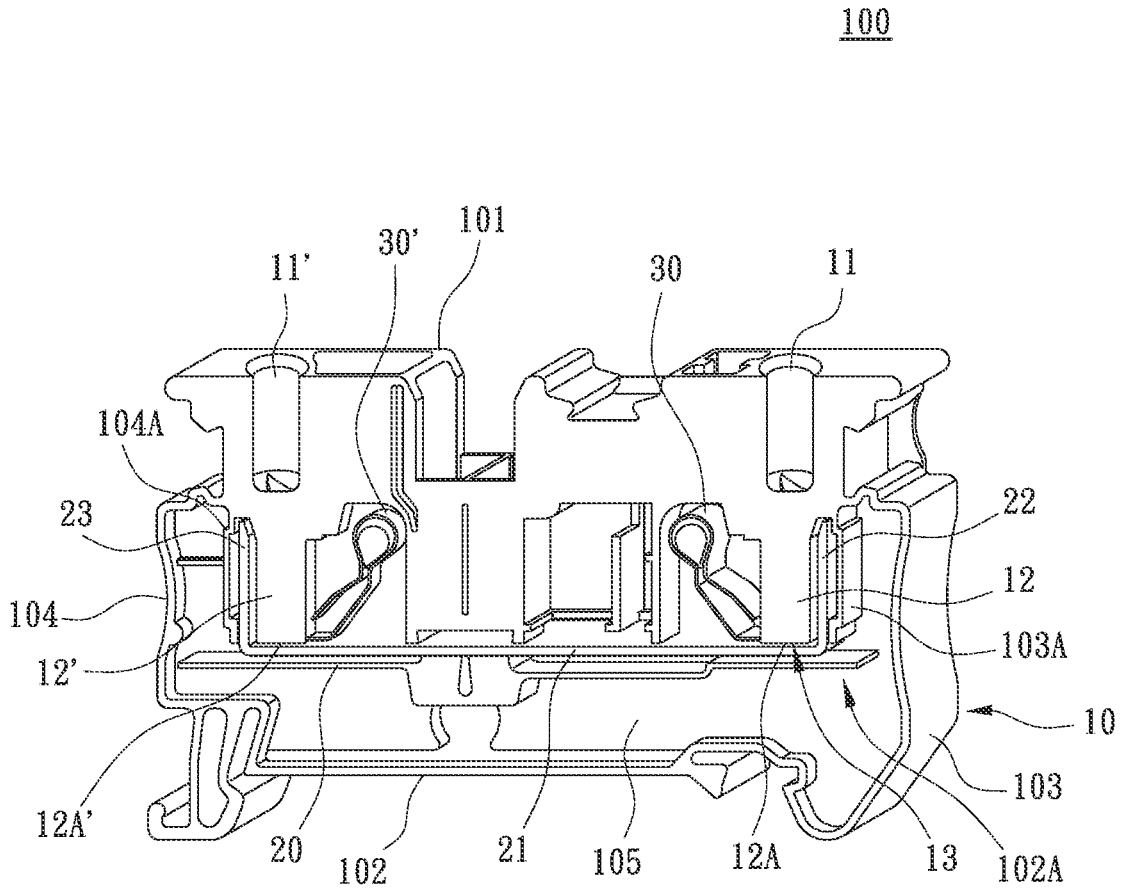
FIG. 1 shows a right-side perspective view of an embodiment of the junction box of the present invention.
Figure 2:
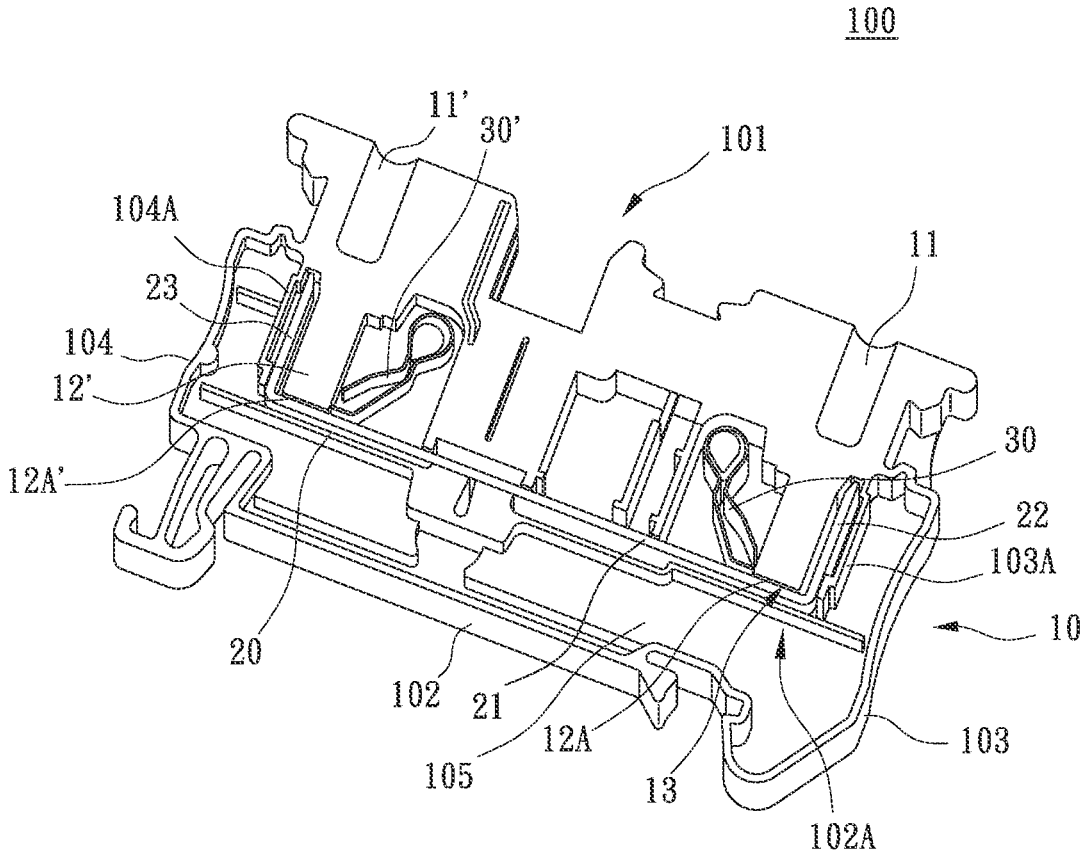
FIG. 2 shows another perspective view of the junction box of the embodiment of FIG. 1.

FIG. 1 shows a right-side perspective view of an embodiment of the junction box of the present invention, and FIG. 2 shows another perspective view of the embodiment of FIG. 1. As shown in the figure, the junction box 100 of the present invention has a box body 10. The box body 10 usually has a complete box wall on the side away from the reader to provide insulation and protection. The box body 10 can generally be exposed to the reader, with only the least necessary shielding. This design can reduce the thickness of the box, while it is also feasible to provide a complete box wall, or a cover, on the near side.

The junction box 100 is structurally divided into two symmetrical sides by a longitudinal centerline. A lead insertion opening 11, 11' is provided on both sides for external leads (not shown) to be inserted. The leads that can be used in the present invention are not particularly limited, and can be various coated or uncoated leads, cables, and the like. The ends of the leads are usually bare metal leads to provide electrical conductions. If the lead insertion direction is inward, a conductive bar 20 is provided inside the lead insertion opening 11, 11'. The conductive bar 20 is made of or contains a conductive material. Suitable conductive materials include various metals, conductive plastics or ceramics. Useful conductive materials are copper, silver, gold, iron, nickel, tin, aluminum, cadmium, etc. The most common are steel, aluminum and copper. The conductive bar 20 includes a main body 21 and a first conductive arm 22 and a second conductive arm 23 provided on both sides of the main body 21. The first conductive arm 22 and the second conductive arm 23 extend toward the opening direction of the lead insertion openings 11, 11'. In the embodiment shown in FIG. 1, the lead insertion openings 11, 11' are provided on a first side wall 101, e.g., the upper side wall of the box body 10, shown in the figure. In this embodiment, the first conductive arm 22 and the second conductive arm 23 both extend toward the first side wall 101. However, the extending direction of the first conductive arm 22 and/or the second conductive arm 23 is not limited to the direction of the first side wall 101. At least one of them can extend in other directions. Moreover, the extending directions of the first conductive arm 22 and the second conductive arm 23 do not need to be consistent with each other.

The guide plates 12, 12' respectively extend from the inner side of the lead insertion openings 11, 11' in the extending direction of the lead, that is, extend inward. The guide plates 12, 12' preferably start to extend from a position of the box body at the lead insertion opening 11, 11'. In this embodiment, the guide plates 12, 12' are preferably integrally formed with the box body 10. However, it is also possible to install separate guide plates 12, 12' on the box body 10. The guide plates 12, 12' respectively extend inward to a position where the main body 21 of the conductive bar 20 is to be installed. The first positioning plate 102A is used to support the conductive bar 20. In a preferred embodiment of the present invention, the first positioning plate 102A is the second side wall 102 of the box body 10, that is, the box wall on the side opposite to the first side wall 101. However, the first positioning plate 102A can also be an additional plate, and is preferably formed by extending the box body 10. According to the junction box 100 of the present invention, the extended ends 12A, 12A' of the guide plates 12, 12' and the first positioning plate 102A are kept at a predetermined distance, and first passage spaces 12C, 12C' are formed between the two, to allow the main body 21 of the conductive bar 20 to pass through during assembly. To achieve this, the distance between the extended ends 12A, 12A' of the guide plates 12, 12' and the first positioning plate 102A is preferably slightly larger than the thickness of the conductive bar 20, or at least slightly larger than the thickness of the part of the main body 21 corresponding to the positioning space 13, 13'.

A plurality of positioning plates 103A, 103B can be additionally formed on the box body 10 to support and/or position the conductive bar 20. The plurality of positioning plates can also be extended from the box body 10 and formed integrally, but it can also be the third side wall 103 and the fourth side wall 104.

The spring clamps 30, 30' are arranged inside the box body 10, and are respectively located on the opposite sides of the first conductive arm 22 and the second conductive arm 23 with respect to the guide plates 12, 12' to provide a pressing force to push the leads against the first conductive arm 22 and the second conductive arm 23, after the leads are located inside the junction box 100, behind the guide plates 12, 12'.

Figure 3:
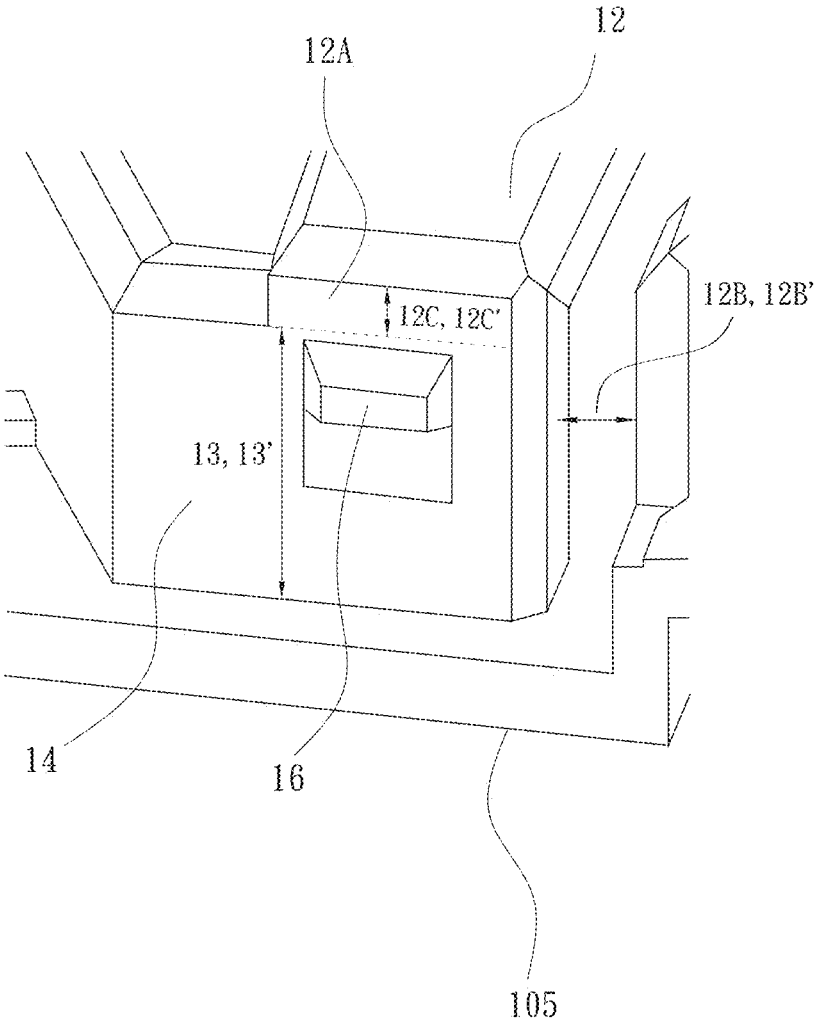
FIG. 3 shows a perspective view of one example of a connecting portion useful in the junction box of the present invention.

The junction box 100 according to the present invention further includes connecting portion 14 formed between the extended ends 12A, 12A' of the guide plates 12, 12' and the corresponding box wall 105. FIG. 3 shows a side view of a connecting portion 14 suitable for the junction box 100 of the present invention. The connecting portion 14 is generally formed in a plate shape. In the embodiment shown in FIG. 3, the connecting portion 14 connects the extended end 12A of the guide plate 12 and the box wall 105 of the box body 10 to support the conductive bar 20. Specifically, after the conductive bar 20 passes through the first passage spaces 12C, 12C' between the extension ends 12A, 12A' of the guide plates 12, 12' and the first positioning plate 102A, it enters the positioning spaces 13, 13' between the connecting portion 14 and the first positioning plate 102A. Here, the first passage spaces 12C, 12C' may also be an extension of the positioning spaces 13, 13'.

According to the present invention, the width of the conductive bar 20, that is, the width in the to-and-from direction in FIG. 1, is configured so that, after the conductive bar 20 passes the first passage space 12C and 12C' between the extended ends 12A, 12A' and the first positioning plate 102A, there will be no part located in the first passage space 12C, 12C'. This design is purely a manufacturing consideration. If necessary, the width of the part can also be set to include the first passage space 12C and 12C' between the extended ends 12A, 12A' of the guide plates 12, 12' and the first positioning plate 102A, and the positioning spaces 13, 13' between the connecting portion 14 and the first positioning plate 102A, while the width of the first conductive arm 22 and the second conductive arm 23 is preferably not greater then the width of the positioning spaces 13, 13' between the connecting portion 14 and the first positioning plate 102A. However, the disadvantage of this design is that the shape of the conductive bar 20 is made complicated.

In addition, the box body 10 also includes second positioning plates 103A and 104A, provided adjacent to a lateral edge of the guide plate 12, 12', that is, the side edge extending perpendicular to the extended ends 12A, 12A' of the guide plates 12, 12', with a predetermined distance to the guide plates 12, 12'. The second positioning plates 103A and 104A are used to support the conductive bar 20, in particular, the first conductive arm 22 and the second conductive arm 23 of the conductive bar 20. In a preferred embodiment of the present invention, the second positioning plates 103A and 104A are the third side wall 103 and the fourth side wall 104 of the box body 10, that is, the two side walls connecting the first side wall 101 and the second side wall 102. However, the second positioning plates 103A and 104A may also be additional plates, and are preferably formed by extending the box body 10. According to the present invention, a predetermined distance is maintained between the lateral edge of the guide plates 12, 12' and the positioning plates 103A, 104A, and second passage spaces 12B, 12B' are formed between the two. The first conductive arm 22 and the second conductive arm 23 of the conductive bar 20 are allowed to pass the second passage spaces 12B, 12B during assembly. To achieve this, the distance between the lateral edge of the guide plates 12, 12' and the second positioning plates 103A, 104A is preferably slightly greater than the thickness of the first conductive arm 22 and the second conductive arm 23.

Figure 4:
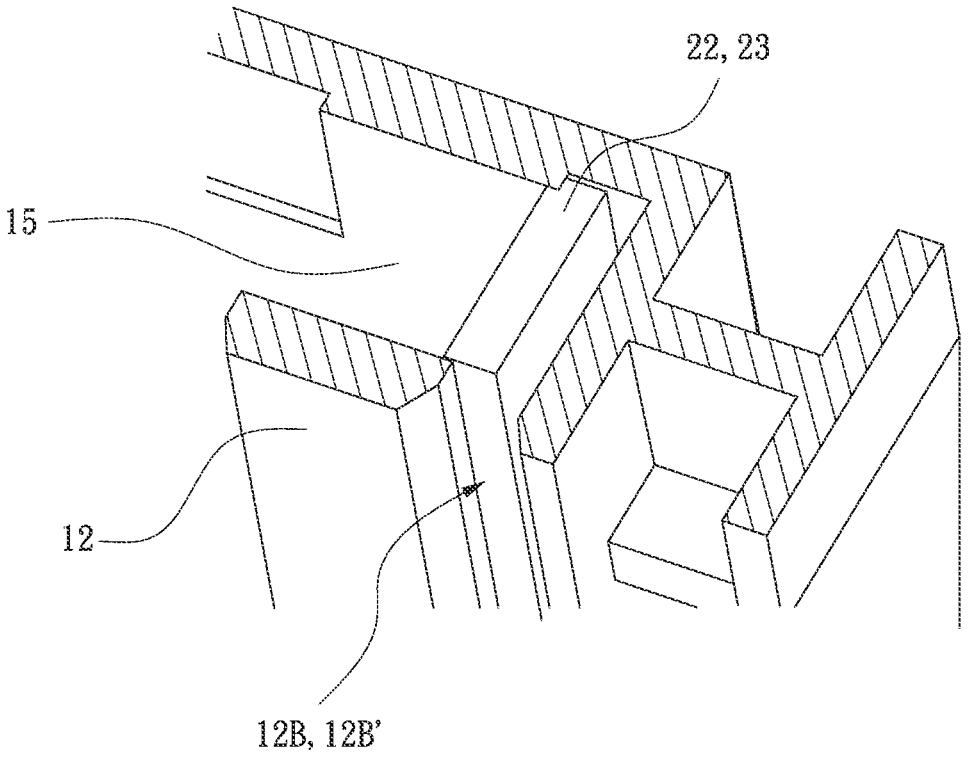
FIG. 4 shows a relative position of a conductive arm and a lead guide plate, after the conductive arm enters the inside of the lead insertion space.

According to a preferred embodiment of the present invention, the first conductive arm 22 and the second conductive arm 23 of the conductive bar 20 pass through the second passage spaces 12B, 12B' during assembly, and then enter the lead insertion space 15, respectively, i.e., the space defined by the guide plate 12, the rear box wall 105, the spring clamps 30, 30' and the second positioning plates 103A, 104A, see FIG. 4.

Figure 5:
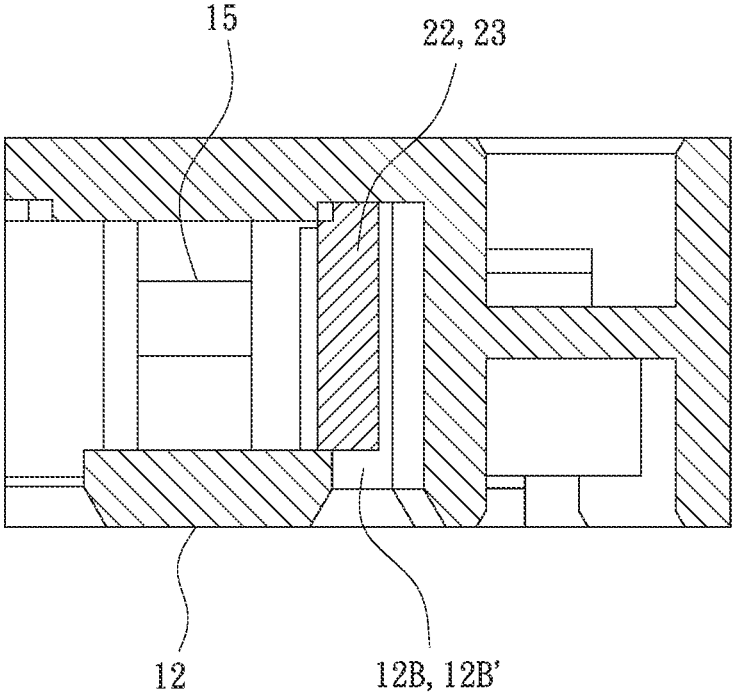
FIG. 5 is a top view of the structure of FIG. 4.

In addition, the first conductive arm 22 and the second conductive arm 23 of the conductive bar 20 are configured so that the first conductive arm 22 and the second conductive arm 23 moves from the plane of the second passage spaces 12B, 12B' to the inside of the lead insertion space 15, after they enter the lead insertion space 15. FIGS. 4 and 5 respectively show the relative position of the first conductive arm 22 and the second conductive arm 23 after the movement in a side view and a cross-sectional top view. In this state after the movement, the free ends of the first conductive arm 22 and the second conductive arm 23, or the part containing the free ends, will be stuck on the inner side of the guide plates 12, 12' to achieve a stable positioning and to provide a more stable clamping effect to the inserted lead.

Figure 6:
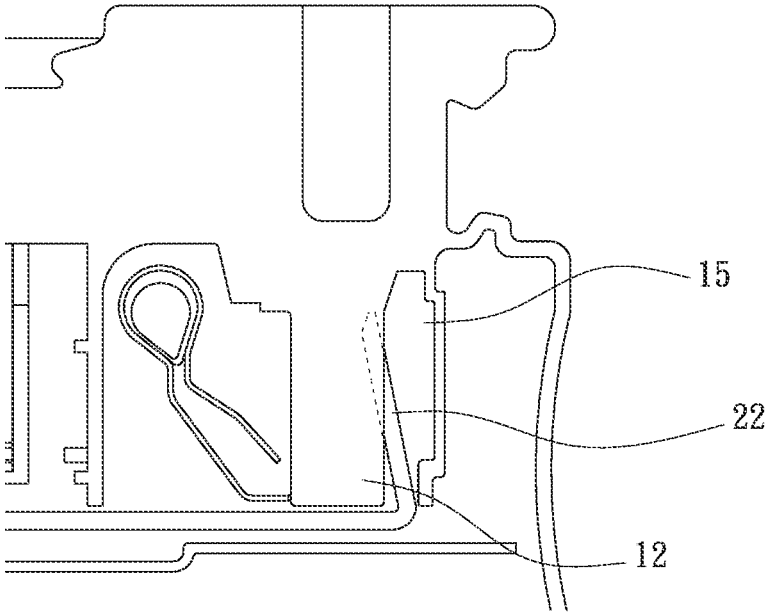
FIG. 6 shows one example of the shape of one conductive arm useful in the junction box of the present invention.

In a preferred embodiment of the present invention, the force to move the first conductive arm 22 and the second conductive arm 23 into the inside the lead insertion space 15, after they passes through the second passage space 12B, 12B', is preferably an elastic force. To achieve this, one or more slight bend may be formed on the main body 21 of the conductive bar 20. For example, a bend that protrudes opposite to the extending direction of the first conductive arm 22 or the second conductive arm 23 may be formed. When assembling the conductive bar 20, flatten the main body 21 with hands or a jig (not shown) and insert the conductive bar 20 into the first and second passage spaces 12C, 12C'. After passing through, release the external force to restore the conductive bar 20 to its original shape. The first conductive arm 22 and the second conductive arm 23 will move to the inside of the lead insertion space 15 due to elastic forces Alternatively or additionally, the free ends of the first conductive arm 22 and/or the second conductive arm 23 of the conductive bar 20 may be slightly bent in the direction of the main body 21, so that the bent section forms an angle slightly less than 180 degrees. When assembling, the conductive arms are flattened with a tool and then the conductive bar 20 is inserted into the first and second passage spaces 12C, 12C'. After passing, the external force is released to restore the conductive bar 20 to its original shape. The free end of the first conductive arm 22 and/or the second conductive arm 23 moves into the lead insertion space 15 due to elastic forces. Another alternative or additional arrangement is to make the conductive bar 20 so that the first conductive arm 22 and/or the second conductive arm 23 is slightly bent in the direction of the main body, as shown in FIG. 6. After entering the lead insertion space 15, the part can be stuck on the rear side of the guide plate 12, 12'. FIG. 6 shows one example of the shape of one conductive arm useful in the junction box of the present invention.

Figure 7:
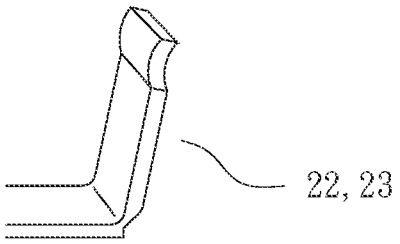
FIG. 7 shows another embodiment of the end section of a conductive arm of a conductive plate suitable for the invented junction box.

FIG. 7 shows another example of the end portion of the conductive bar suitable for the junction box of the present invention. The structure of FIG. 7 can be regarded as a modification of the previous embodiment. In this embodiment, the free end of the first conductive arm 22 and/or the second conductive arm 23 of the conductive bar 20 is first bent in the direction of the main body, and then bent in the opposite direction, forming two bends. This design helps to make the end of the free end face upward to form a larger area of contact with the inserted lead.

The free end of the first conductive arm 22 and/or the second conductive arm 23 of the conductive bar 20 may form, for example, with an inscribed circular arc surface, so as to be compatible with a generally cylindrical shape of the inserted lead, to form a better contact. The design of the inscribed can be applied to any embodiment of the present invention. And there is no restriction on the shape of the inscribed. Depending on the manufacturing process, different inscribed shapes can be determined, as long as it can form a larger area of contact with the inserted lead. For example, two flat inner walls at any angle would provide the same function.

After the assembly is completed, the conductive bar 20 will be located inside the lead insertion space 15 between the guide plates 12, 12' and the box wall 105. It is usually not located in the first passage space 12C, 12C' and/or the second passage space 12B, 12B'.

In a preferred embodiment of the present invention, the connecting portion 14 at the extended end of the guide plate 20 may be provided with a positioning block 16, see FIG. 3. At the same time, a positioning notch (not shown) can also be provided at the corresponding position of the main body 21 of the conductive bar 20. When assembling, after the conductive bar 20 passes through the first passage spaces 12C, 12C' and the second passage spaces 12B, 12B', the positioning block 16 can be embedded in the positioning notch to achieve a more stable positioning.

Alternatively or additionally, a positioning notch (not shown) may be formed in the connecting portion 14, and a positioning block (not shown) may be formed at a corresponding position of the conductive bar main body 21. The assembly method would be the same.

Figure 8:
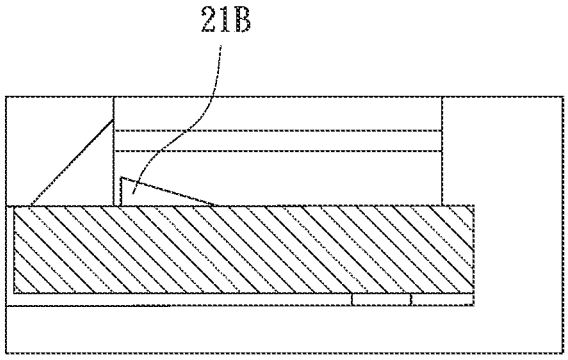
FIG. 8 shows another embodiment of the combination of a conductive plate and a lead guide plate suitable for the junction box of the present invention.

Alternatively or additionally, a convex stopper 21B can be formed on the main body 21 of the conductive bar 20 at a position corresponding to an edge of the guide plates 12, 12' after assembly, to stuck the conductive bar 20 on the inner side of the guide plates 12 and 12', after passing through the second passage spaces 12B and 12B', as shown in FIG. 8. FIG. 8 shows the relation of a conductive bar and a lead guide plate suitable for the junction box of the present invention. In this way, the positioning notch can be omitted.

In the junction box 100 described above, the box body 10 on one side, the lead insertion opening 11 on the side, the conductive bar 20 extending from the lead insertion opening 11 and the first conductive arm 22 of the conductive bar 20, as well as the connecting portion 14 supporting the conductive bar 20, the positioning plates 102A, 103A, the first passage space 12C, the second passage space 12B, and the positioning space 13, form a lead connection module. One, two or more lead connection modules of the present invention can be provided in a junction box to provide various functions.

For example, a junction box may only include one lead connection module of the present invention, which is connected to a lead connection module that is not one of this invention and is located inside or outside the junction box. A junction box including two lead connection modules of the present invention, with the conductive bar 20 used for electrical and structural connection, would be a typical application. However, three or more of the invented lead connection modules can be provided in one junction box to provide various applications.

The present invention has been described in relation to particular examples, which are intended in all respects to be illustrative rather than restrictive. Those skilled in the art will appreciate that many different combinations will be suitable for practicing the present invention. Various aspects and/or components of the described embodiments may be used singly or in any combination. It is intended that the specification and examples be considered as exemplary only, with a true scope and spirit of the invention being indicated by the following claims.

What is claimed is:

1. A junction box, comprising:

a box body, comprising at least one lead insertion opening on the box body for inserting a lead;

a guide plate extending in a lead insertion direction from the box body adjacent to the lead insertion opening, for guiding the lead after being inserted;

wherein a lateral connecting portion extends from an extended end of the guide plate to the box body, wherein a first positioning plate and a second positioning plate protrude laterally from the box body and are configured to form a first passage space between the first positioning plate and the extended end of the guide plate and a second passage space between the second positioning plate and one side of the guide plate; and wherein the guide plate, the connecting portion and the second positioning plate define a lead insertion space accessible from the second passage space;

a conductive bar formed in a plate shape and having at least one bend to form a main body and at least one first conductive arm extending from the main body at an angle;

wherein a part of the main body of the conductive bar is disposed between the connecting portion and the first positioning plate, and the first conductive arm of the conductive bar is located in the lead insertion space;

characterized in that the thickness of the first conductive arm of the conductive bar is configured so that the first conductive arm can pass through the second passage space and enter the lead insertion space; and that the first conductive arm of the conductive bar is configured to moves from a plane where the second passage space is located to an inside of the lead insertion space, after entering the lead insertion space.

2. The junction box of claim 1, further comprising at least one spring clamp, disposed in the lead insertion space, at a side opposite to the first conductive arm in respect to the guide plate, to press the inserted lead toward the first conductive arm.

3. The junction box of claim 1, wherein the first and/or second positioning plate is formed by the box wall of the box body.

4. The junction box of claim 1, further comprising a positioning means provided in the connection portion.

5. The junction box of claim 1, wherein the first conductive arm is moved into the first lead insertion space by an elastic force, after it enters the first lead insertion space.

6. The junction box of claim 5, wherein one or more slight bend is provided on the main body of the conductive bar, with a protrusion direction opposite to an extending direction of the first conductive arm.

7. The junction box of claim 5, wherein the first conductive arm of the conductive bar is further bent towards the main body, to form an angle slightly less than 90 degrees with the main body.

8. The junction box of claim 5, wherein a free end of the first conductive arm of the conductive bar is bend towards the main body first, then in an opposite direction.

9. The junction box of claim 5, wherein a free end of the first conductive arm of the conductive bar has an inscribed circular arc surface or two intersecting planes.

10. The junction box of claim 1, wherein the box body further comprises:

a second lead insertion opening, a second guide plate, extending in an insertion direction of a lead from a position adjacent to the second lead insertion opening of the box body, wherein a second lateral connecting portion extends from an extended end of the second guide plate to connect the box body; and a second pair of first positioning plate and second positioning plate protruding laterally and configured to form a second pair of first passage space between the first positioning plate and the extended end of the second guide plate, and second passage space between the second positioning plate and one side of the second guide plate; wherein the second guide plate, the connecting portion and the second positioning plate of the second pair define a second lead insertion space accessible from the second passage space of the second pair;

wherein the conductive bar further comprises a second conductive arm located on the main body opposite to the first conductive arm and extending parallel to the first conductive arm;

wherein a part of the main body of the conductive bar is disposed between the connecting portion of the second guide plate and the first positioning plate, and the second conductive arm of the conductive bar is located in the lead insertion space; and wherein the second conductive arm of the conductive bar moves from a plane of the second passage space to an inside of the second lead insertion space, after entering the second lead insertion space.

11. The junction box of claim 10, further comprising at least one spring clamp, disposed in the second lead insertion space, at a side opposite to the second conductive arm in respect to the second guide plate, to press the inserted lead toward the second conductive arm.

12. The junction box of claim 10, wherein the second pair of first and/or second positioning plate is formed by the box wall of the box body.

13. The junction box of claim 10, wherein the first and/or second conductive arm is moved into the first and/or second lead insertion space by an elastic force, after it enters the first and/or second lead insertion space.

14. The junction box of claim 13, wherein one or more slight bend is provided on the main body of the conductive bar, with a protrusion direction opposite to an extending direction of the first and/or second conductive arm.

15. The junction box of claim 13, wherein the first and/or second conductive arm of the conductive bar is further bent towards the main body, to form an angle slightly less than 90 degrees with the main body.

16. The junction box of claim 13, wherein a free end of the first and/or second conductive arm of the conductive bar is bend towards the main body first, then in an opposite direction.

17. The junction box of claim 13, wherein a free end of the first and/or second conductive arm of the conductive bar has an inscribed circular arc surface or two intersecting planes.

* * * * *